US006766621B2

(12) United States Patent
Reppermund

(10) Patent No.: US 6,766,621 B2
(45) Date of Patent: Jul. 27, 2004

(54) REINFORCED DOOR STILE

(75) Inventor: Eric A. Reppermund, Export, PA (US)

(73) Assignee: Snavely Forest Products, Pittsburgh, PA (US)

( * ) Notice: Subject to any disclaimer, the term of this patent is extended or adjusted under 35 U.S.C. 154(b) by 0 days.

(21) Appl. No.: 10/144,296

(22) Filed: May 13, 2002

(65) Prior Publication Data

US 2003/0208972 A1 Nov. 13, 2003

(51) Int. Cl.[7] ..... E06B 1/04
(52) U.S. Cl. ..... 52/204.1
(58) Field of Search ..... 52/204.1, 202, 52/203, 455, 63, 656.9, 656.7, 656.4; 29/460, 527.1, 455.1, 463

(56) References Cited

U.S. PATENT DOCUMENTS 3,987,600 A * 10/1976 Baehr ..... 52/232
4,002,195 A * 1/1977 Nagase ..... 160/379
4,577,577 A * 3/1986 Eriksson ..... 114/120
4,644,992 A * 2/1987 Jerila ..... 160/213
5,887,391 A * 3/1999 Shoup ..... 52/202
6,209,272 B1 * 4/2001 Holzaepfel ..... 52/204.591
6,250,040 B1 * 6/2001 Green ..... 52/656.7
6,301,852 B1 * 10/2001 Eshelman ..... 52/456
6,467,219 B1 * 10/2002 Gardner ..... 49/74.1

* cited by examiner

*Primary Examiner*—Leslie A. Braun
*Assistant Examiner*—A. Joseph Wujciak, III
(74) *Attorney, Agent, or Firm*—James Ray & Associates

(57) ABSTRACT

In combination with a door in which the door includes two spaced apart solid plastic stiles and at least two spaced apart solid plastic rails and in which the two solid plastic stiles and the at least two solid plastic rails are connected together to form a rectangle having an opening defined by the distances between an inner edge of the solid plastic rails and the solid plastic stiles. At least one of a screen and a glass are dimensioned to cover such opening. Further, there is a means for fastening the screen and/or glass in a position to cover the opening. The improvement comprises at least one of the two solid plastic stiles and/or two rails having a lengthwise void formed at a predetermined location therein. A non-plastic reinforcing member is fitted in the lengthwise void.

17 Claims, 6 Drawing Sheets

REINFORCED DOOR STILE

FIELD OF THE INVENTION

The present invention relates, in general, to screen and storm doors and to their manufacture and installation. The present invention relates generally to the use of plastics, particularly vinyl, as a replacement for wood or metal based products and, more particularly, the present invention relates to reinforced vinyl for these doors.

BACKGROUND OF THE INVENTION

Screen and storm doors have been generally made of wood or metal such as aluminum or steel. Wood has some inherent drawbacks. It must be painted or coated to protect it from the elements. If made of less expensive wood, such as pine, it may split or warp. If the door is made of aluminum, steel or any of the more expensive wood materials the door can become quite expensive.

Polyvinyl chloride has been used in the past to replace wood in siding, shutters and parts of windows and now polyvinyl chloride is very commonly used for these applications. Windows and shutters, whether vinyl or wood, are made to specific measurements rather than custom fitted at the job site. These items are generally hollow to save material and decrease weight. For added strength, ribs or other interior structures are added as needed to increase the strength of these products.

Screen doors cannot be made of the same materials as vinyl shutters and windows. The door needs to fit closely in a door frame that may or may not be rectangular or "plumb" but may be narrower at the top or bottom. Screen doors made of wood can be cut at the job site. Hollow vinyl doors on the other hand, especially one with reinforcing bars, cannot be trimmed at the job site without the risk of cutting through the wall without jeopardizing the structural integrity and appearance of the door.

Thus, there remained a need for a screen door that did not have the disadvantages of either aluminum or wood and that could be custom fitted at the job site.

As taught in U.S. Pat. No. 6,250,040, which is incorporated herein by reference thereto, a screen door is made wherein the frame is formed of foamed, closed cell polyvinyl chloride instead of wood or other materials. The stiles and rails of this invention are formed of substantially solid, extruded vinyl rather than hollow core vinyl and are fastened together with screws and dowels and adhesive to form a rectangular frame with an opening defined between the stiles and rails for the screen. A groove is milled into the frame around the screen opening for receiving the screen and spline that holds it in place.

This door can be taken to the job site and the edges cut and trimmed using standard woodworking tools to fit the door to a particular door frame. The use of the solid, foamed polyvinyl chloride permits the edges of the door frame to be trimmed, removing even more than an inch from each edge. Thus, it is possible to fit the door to a particular door frame. Furthermore the solid material does not split, as wood does, allowing the stiles and rails to be fastened by screws that can bite into the material and the material closes around them for a superior joint.

The use of the solid foamed vinyl, although presenting many desirable qualities, is still subjected to the variances in temperature which may cause the stiles or rails to warp if the temperature is hot and further may become brittle when the temperature becomes cold.

SUMMARY OF THE INVENTION

Thus, the present invention provides in combination with a door which includes two spaced apart solid plastic stiles and at least two spaced apart solid plastic rails and in which the two solid plastic stiles and the at least two solid plastic rails are connected together to form a rectangle having an opening defined by the distances between an inner edge of the solid plastic rails and the solid plastic stiles. At least one of a screen and a glass are dimensioned to at least cover the opening. There is a means for fastening the at least one of the screen and glass in a position to at least cover the opening.

The improvement comprises at least one of the two solid plastic stiles having a lengthwise void formed at a predetermined location therein. A non-plastic reinforcing member is fitted in the lengthwise void.

In an alternate embodiment of the invention there is provided in combination with a door which includes two spaced apart solid plastic stiles and at least two spaced apart solid plastic rails and in which the two solid plastic stiles and the at least two solid plastic rails are connected together to form a rectangle having an opening defined by the distances between an inner edge of the solid plastic rails and the solid plastic stiles. At least one of a screen and a glass are dimensioned to at least cover the opening. There is a means for fastening the at least one of the screen and glass in a position to at least cover the opening.

The improvement comprises at least one of the at least two solid plastic rails having a lengthwise void formed at a predetermined location therein and a non-plastic reinforcing member fitted in such lengthwise void.

In yet another alternate embodiment of the invention there is provided a process for producing a door. The process comprises the steps of first extruding two stiles of solid foam filled plastic and extruding at least two rails of solid foam filled plastic. Another step is forming a lengthwise void in at least one of at least one of the two stiles and at least one of at least two rails that were formed in the previous steps.

Another step is fitting the void that was formed in at least one of the two stiles and/or at least one of the two rails with a non-plastic reinforcing member. Another step involves forming a rectangular frame of the two stiles and at least two rails, such rectangular frame having an opening defined by the distances between an inner edge of the rails and the stiles.

The process further includes the steps of providing at least one of a screen and a glass that are dimensioned to at least cover the opening and also providing a means for fastening the at least one of such screen and such glass in a position to at least cover the opening.

OBJECTS OF THE INVENTION

It is, therefore, one of the primary object of the present invention to provide a door in which there is a lengthwise void in one of the stiles or rails and in which such void is fitted with a non-plastic reinforcing member.

Another object of the present invention is to provide a door in which aluminum is used as the reinforcing member.

It is yet another object of the present invention to extrude the aluminum reinforcing member along with the solid plastic.

Still another object of the present invention is to form and fit the void such that it is offset so that hinges or other mounting hardware is engageable with the non-plastic reinforcing member that is disposed in the void.

These and various other objects and advantages of this invention will become apparent after a full reading of the following detailed description, particularly, when read in conjunction with the attached drawings as described below and the appended claims.

Figure 1:
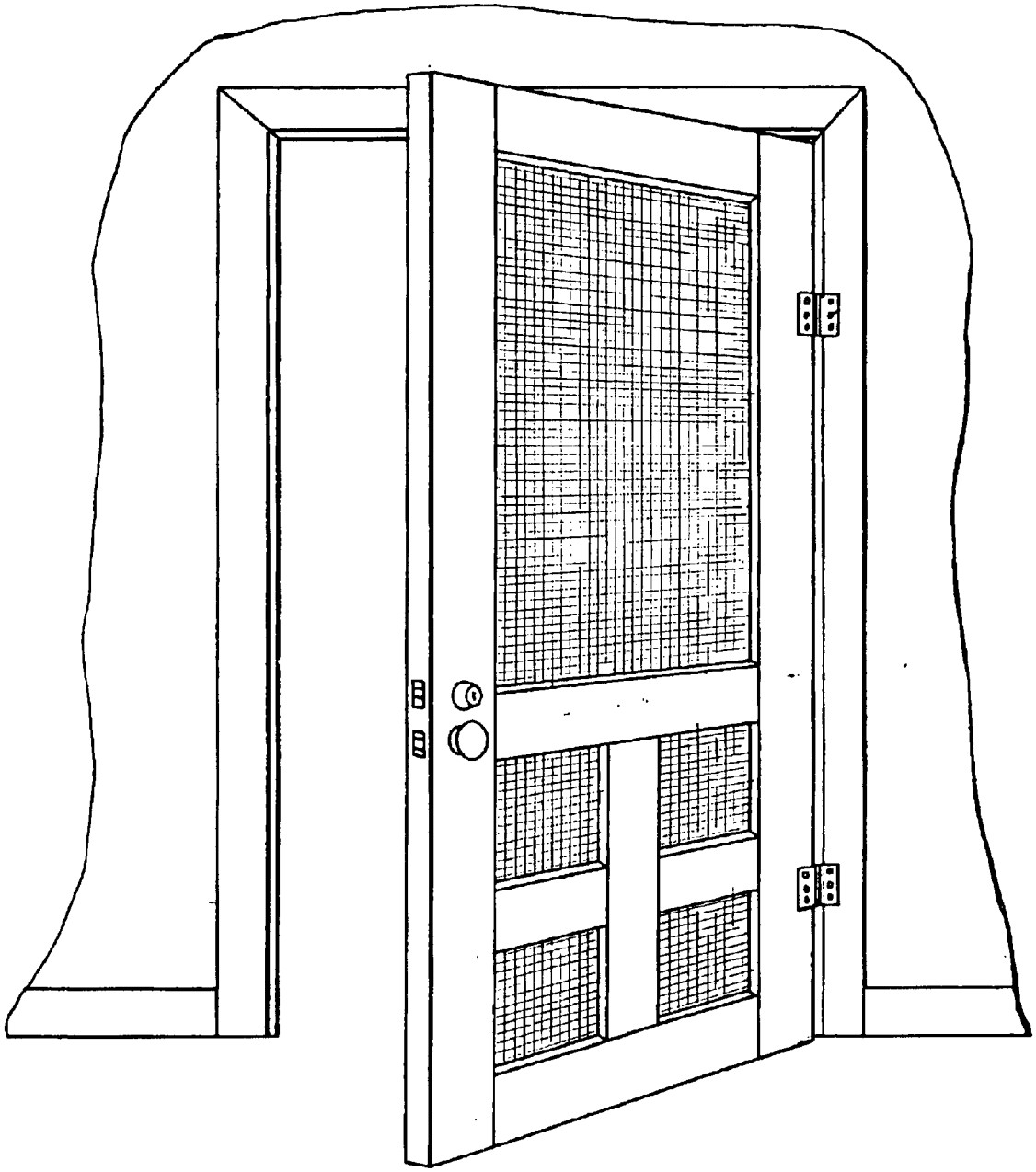
FIG. 1 PRIOR ART
FIG. 1 is a perspective view of a prior art screen door.

BRIEF DESCRIPTION OF THE PRESENTLY PREFERRED AND ALTERNATE EMBODIMENTS OF THE INVENTION

Prior to proceeding with the more detailed description of the present invention it should be noted that, for the sake of clarity, identical components which have identical functions have been designated by identical reference numerals throughout the several views illustrated in the drawings.

Illustrated in FIG. 1 is a perspective view of a screen door described in U.S. Pat. No. 6,250,040, which is incorporated herein by reference thereto. The present invention provides a door, generally designated 10, as is seen in such prior art in FIG. 1. In the description that follows such door 10 is generally described as including a screen; however, it is within the scope of the invention that such door could also be made, according to some embodiments of the invention, to include a glass instead of a screen.

The door 10 is comprised of two spaced apart solid plastic stiles 2 and at least two spaced apart solid plastic rails 4. The two solid plastic stiles 2 and the at least two solid plastic rails 4 are connected together to form a rectangle which has an opening defined by the distances between an inner edge of the solid plastic rails 4 and the solid plastic stiles 2. If there are three rails 4 on the door then two rectangles are formed having openings defined by the distances between the inner edges of the two stiles 2 and inner edges of the three rails 4.

The door 10, further, has at least one of a screen 14 and a glass that is/are dimensioned to cover the opening or openings. There is, further, a means for fastening the at least one of a screen 14 and a glass in a position to cover the opening.

Figure 2A:
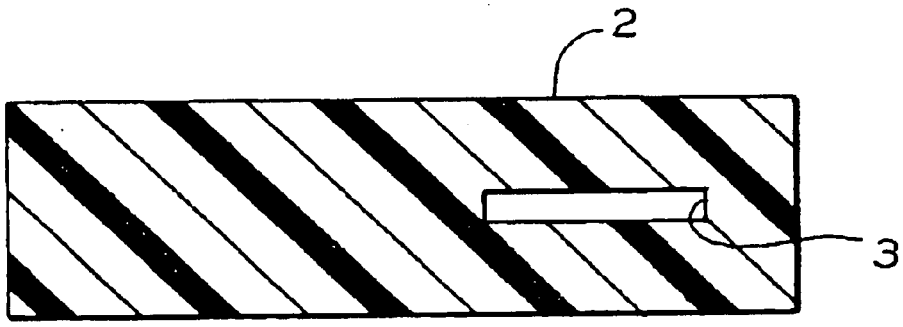
FIG. 2*a* is a cross sectional view of a stile or a rail according to an embodiment of the invention which shows a void disposed therein.
Figure 2B:
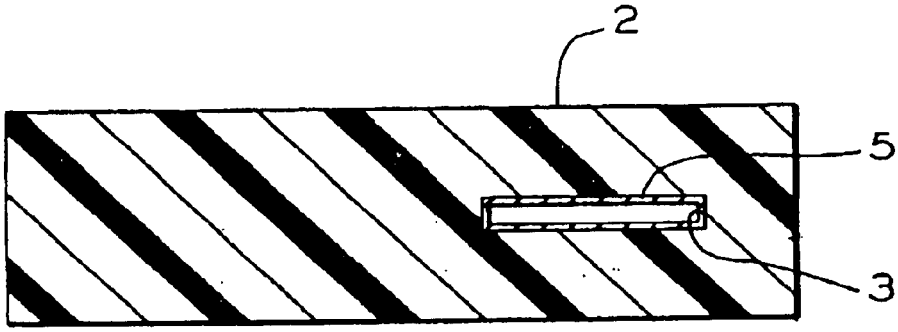
FIG. 2*b* is a cross sectional view of a stile or rail similar to FIG. 2*a* but with a generally hollow non-plastic reinforcing member fitted into the void.
Figure 2C:
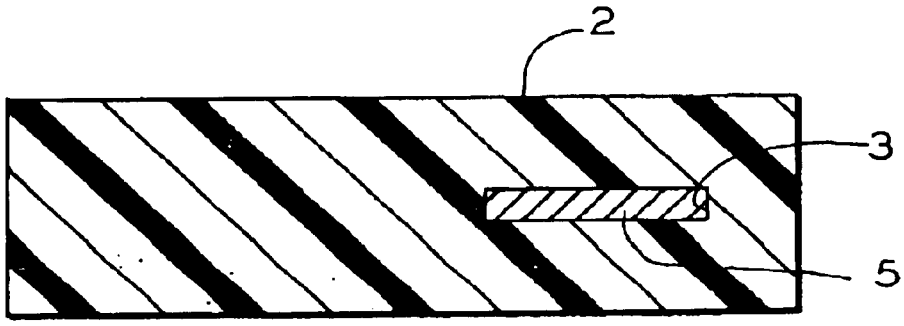
FIG. 2*c* is a cross sectional view of a stile or rail similar to FIG. 2*c* but with a generally solid non-plastic reinforcing member fitted into the void.
Figure 3:
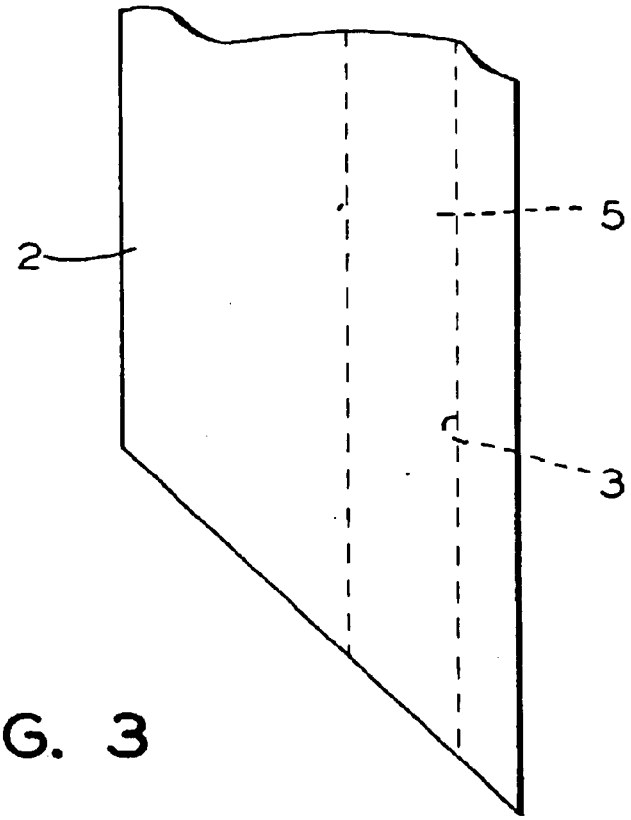
FIG. 3 is a lengthwise section of a stile or rail showing the void in outline.

As is evident in FIGS. 2*a*, 2*b*, 2*c* and 3 the present invention provides an improvement over the prior art doors in that at least one of the two solid plastic stiles 2 has a lengthwise void 3 formed at a predetermined location therein. FIGS. 2 and 3 are described as a stile 2; however, it is within the scope of the invention that it could also describe a rail 4 having such void 3 disposed therein. Further, the invention provides for a reinforcing member 5, preferably non-plastic, to be fitted into the lengthwise void 3 that was formed in one of the stiles 2 and/or one of the rails 4. It is presently preferred that such void 3 and such non-plastic reinforcing member 5 be present in at least one of the stiles. FIG. 2*b* shows such non-plastic reinforcing member 5 being a generally hollow member while FIG. 2*c* shows such non-plastic reinforcing member 5 as being generally solid.

In a presently preferred embodiment of the invention such a void 3 is rectangular in shape. It is also presently preferred that such solid plastic stiles 2 and rails 4 be formed of foamed vinyl and it is also preferred that such foamed vinyl is polyvinyl chloride.

The void 3 can be created during extrusion and such non-plastic reinforcing member 5 can be inserted in the void 3 in the foamed vinyl by being extruded simultaneously with the foamed vinyl or it could be inserted into the void 3 prior to the foamed vinyl being fully cooled after extrusion. The non-plastic reinforcing member 5 could also be secured to the void 3, if necessary, by press fitting, by adhesive bonding and by mechanically locking.

In a presently preferred embodiment of the invention such non-plastic reinforcing member 5 is aluminum. It is also presently preferred that both of the two stiles 2 include the non-plastic reinforcing member 5.

In another embodiment of the invention it is preferred that the void 3 is offset with respect to a longitudinal axis of the stile 2 in its placement in the door 10. The void 3, and the non-plastic reinforcing member 5 disposed therein, is offset so that the hinges and/or other mounting hardware (not shown) are engageable with the non-plastic reinforcing member 5. This offset allows for better and more secure alignment of the door hinges by being in contact with the reinforcing member 5. This also allows for the handles and other hardware holes on the opposing stile 2 to be more easily drilled where it is not in contact with the reinforcing member 5.

In still another embodiment of the invention such foam plastic used to form the stiles and rails is further strengthened by including fiber reinforcing in the vinyl before it is extruded. The fiber reinforcing is selected from the group consisting of metal, glass and other plastic fibers that have melting points higher than that of the solid plastic being used to form the stiles 2 and rails 4.

It is also preferred that the at least two spaced apart solid plastic rails 4 used to form the door be three rails 4. Thus, in a door 10 where two solid plastic stiles 2 and three solid plastic rails 4 are connected together, two (openings) rectangles are formed. The two openings are defined by the distances between an inner edge of the solid plastic rails 4 and the solid plastic stiles 2. Again, at least one of a screen 14 and a glass are dimensioned to cover the openings and there is a means for fastening the screen and/or glass in a position to cover these openings.

Figure 4:
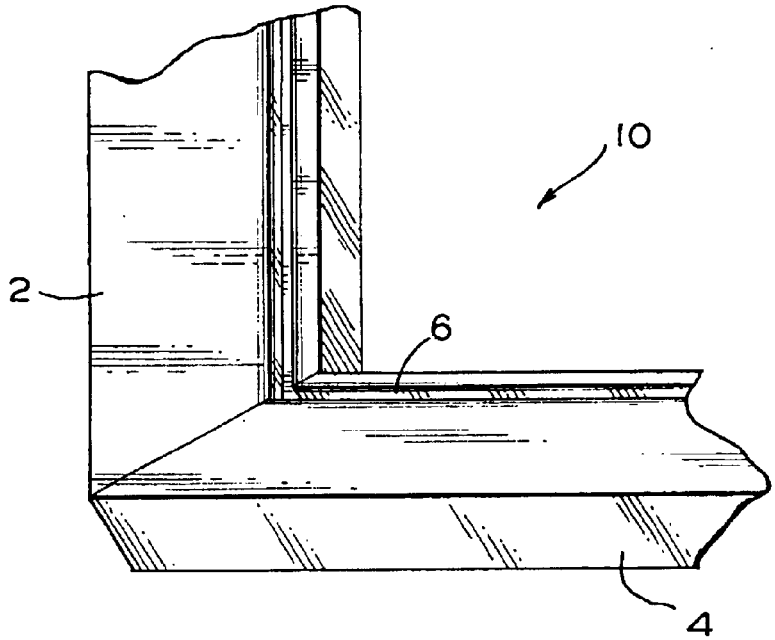
FIG. 4 is a perspective view of a portion of a door with a groove formed therein.
Figure 5:
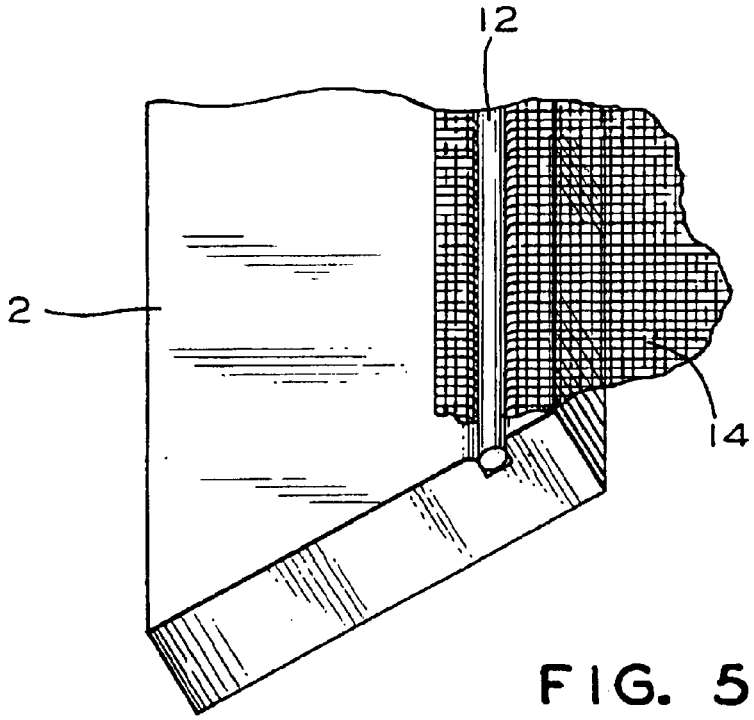
FIG. 5 is a perspective view of a portion of a stile or a rail of the door shown in FIG. 4 showing the mounting of a screen by a traditional spine in groove method.

Attention is now directed to FIGS. 4 through 10 in which are illustrated various means of securing a screen and/or glass to the door 10. In FIGS. 4 and 5 is illustrated a traditional spine and groove method of attaching a screen to a door. In this method a groove or channel 6 in routed in the back of the stiles 2 and rails 4, close to an inner edge of these door members. The edges of the screen 14 is inserted into the channel or groove 6 using a piece of rubber cord (spline) 12. The screen 14 is wrapped around the spline 12 as it inserted into the groove 6 and remains in place because it has been wedged into the groove.

Figure 6:
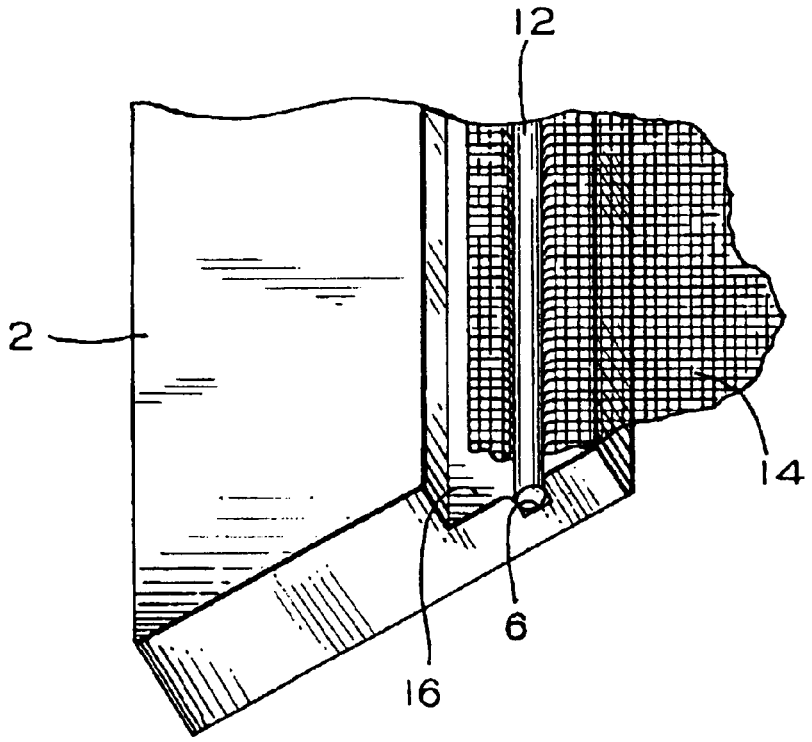
FIG. 6 is a perspective view of a portion of a stile or rail of the door shown in FIG. 4 with a rabbeted area formed therein along with the groove.
Figure 7:
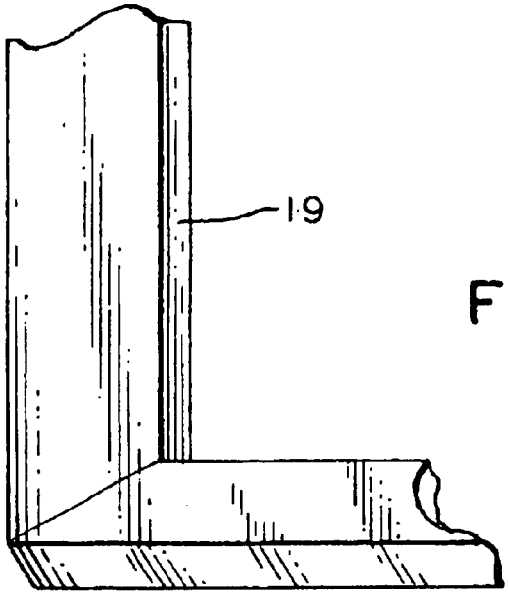
FIG. 7 is a perspective view of a mould which fits into the rabbeted area shown in FIG. 6.

FIGS. 6 and 7 show another method of a securing a screen to a door and is similar to the spine and groove method. In this method a rabbeted area 16 is routed in the inner edges of stiles 2 and rails 4. A groove 6 is formed into the rabbeted area 16 similar to the previous method. Such groove 6 could be formed first and then the area around the groove be routed to make the rabbeted area 16. The screen 14 is mounted using a spline 12 as in the previous method. However, in this method a mold 19 is formed that fits into the rabbeted area 16 over the top of spline 12 with the screen 14 secured. The mold 19 is then attached to the door 10 by nails or screws to provide additional strength making it more difficult to pull the splined screen out of the groove 6.

Figure 8:
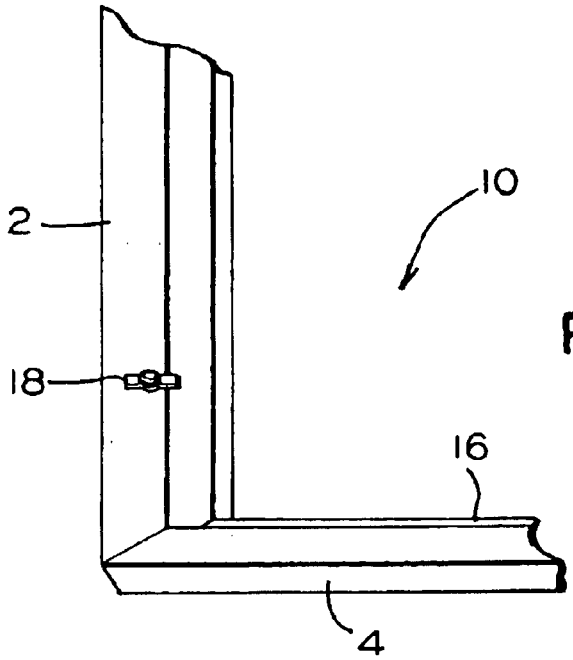
FIG. 8 is a perspective view of a portion of a door with a rabbeted area formed therein.
Figure 9:
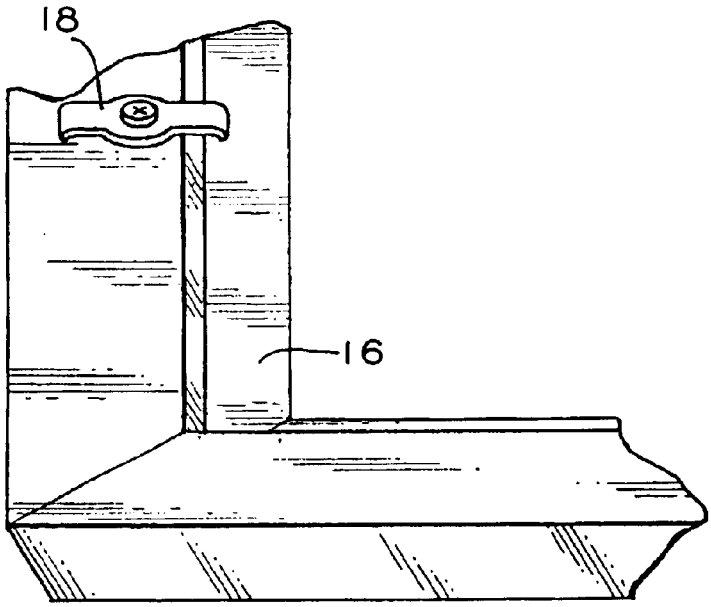
FIG. 9 is an enlarged perspective view of a portion of the stile or rail shown in FIG. 8 showing a means for securing a screen or glass to the door.
Figure 10:
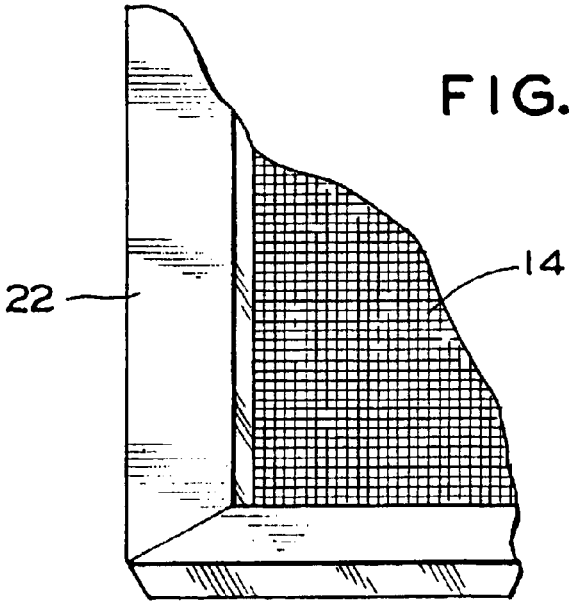
FIG. 10 is a perspective view of a portion of a frame containing a screen or glass for mounting into the rabbeted area shown in FIG. 9.

FIGS. 8, 9 and 10 show another method of securing a screen 14 and/or glass to such door 10. In this method a rabbeted area 16 is routed in the inner edges of stiles 2 and rails 4. The screen 14 and/or glass is attached to a frame 22. Frame 22 is inserted into the rabbeted area 16 of such door 10. The frame 10 is locked in place by using at least 2 pivoting arms 18 mounted to the stiles 2 or rails 4. The pivoting arms 18 are turned so as to fit over the frame 22 and thus secure the frame 22 to the door 10 or they are turned so as not fit over the frame 22 so as to permit removal of the frame 22 with its screen 14 or glass mounted therein.

While both the presently preferred and a number of alternative embodiments of the present invention have been described in detail above it should be understood that various other adaptations and modifications of the present invention can be envisioned by those persons who are skilled in the relevant art without departing from either the spirit of the invention or the scope of the appended claims.

I claim:

1. In combination with a door, said door including two spaced apart solid plastic stiles and at least two spaced apart solid plastic rails, said two solid plastic stiles and said at least two solid plastic rails being connected together to form a rectangle having an opening defined by the distances between an inner edge of said solid plastic rails and said solid plastic stiles, at least one of a screen and a glass dimensioned to cover said opening and means for fastening said at least one of said screen and said glass in a position to at least cover said opening; the improvement comprising:

(a) at least one of said two solid plastic stiles having a lengthwise void formed at a predetermined location therein; and (b) a reinforcing member fitted in said lengthwise void.

2. The combination, according to claim 1, wherein said solid plastic is foamed vinyl.

3. The combination, according to claim 2, wherein said foamed vinyl is polyvinyl chloride.

4. The combination, according to claim 2, wherein said reinforcing member is inserted in said void by of one being extruded simultaneously with said foamed vinyl, inserted into said void prior to said foamed vinyl being fully cooled after extrusion, press fitting, adhesively bonding and mechanically locking.

5. The combination, according to claim 4, wherein said reinforcing member is non-plastic.

6. The combination, according to claim 1, wherein both of said at least one of said two stiles have a lengthwise void formed therein and said lengthwise void further includes said reinforcing member fitted into said void.

7. The combination, according to claim 1, wherein said void is generally rectangular.

8. The combination, according to claim 4, wherein said void is offset with respect to a longitudinal axis of said stile in its placement in said at least one of said two stiles.

9. The combination, according to claim 8, wherein said void is offset so that at least one of hinges and other mounting hardware is engageable with said reinforcing member disposed in said void.

10. The combination, according to claim 1, wherein said stile further includes fiber reinforcing, said fiber reinforcing selected from the group consisting of metal, glass and other plastic fibers having melting points higher than said solid plastic being used to form said stiles.

11. The combination, according to claim 1, wherein said door includes three spaced apart solid plastic rails.

12. The combination, according to claim 11, wherein said two solid plastic stiles and said three solid plastic rails being connected together to form two rectangles having two openings defined by the distances between an inner edge of said solid plastic rails and said solid plastic stiles, at least one of a screen and a glass dimensioned to cover said openings and means for fastening said at least one of said screen and said glass in a position to cover said openings.

13. In combination with a door, said door including two spaced apart solid plastic stiles and at least two spaced apart solid plastic rails, said two solid plastic stiles and said at least two solid plastic rails being connected together to form a rectangle having an opening defined by the distances between an inner edge of said solid plastic rails and said solid plastic stiles, at least one of a screen and a glass dimensioned to cover said opening and means for fastening said at least one of said screen and said glass in a position to at least cover said opening; the improvement comprising:

(a) at least one of said at least two solid plastic rails having a lengthwise void formed at a predetermined location therein; and (b) a reinforcing member fitted in said lengthwise void.

14. The combination, according to claim 13, wherein said solid plastic is foamed vinyl.

15. The combination, according to claim 13, wherein said vinyl is polyvinyl chloride.

16. The combination, according to claim 14, wherein a non-plastic reinforcing member is inserted in said void by one of being extruded simultaneously with said foamed vinyl, inserted into said void prior to said foamed vinyl being fully cooled after extrusion, press fitting, adhesively bonding and mechanically locking.

17. The combination, according to claim 16, wherein said reinforcing member is aluminum.

* * * * *